US006045467A

United States Patent [19]

Anderson

[11] Patent Number: 6,045,467

[45] Date of Patent: Apr. 4, 2000

[54] WELDLESS KNOB FOR METAL BASEBALL AND SOFTBALL BATS

[76] Inventor: Steven L. Anderson, 3100 Taft Way, Costa Mesa, Calif. 92626

[21] Appl. No.: 09/056,969

[22] Filed: Apr. 9, 1998

[51] Int. Cl.[7] ..... A63B 59/06

[52] U.S. Cl. ..... 473/568; 473/566

[58] Field of Search ..... 473/566, 568, 473/562, 457, 8 R, 170

[56] References Cited

U.S. PATENT DOCUMENTS

| | | | |
|---|---|---|---|
| 748,000 | 12/1903 | Murnane | 473/568 |
| 1,611,858 | 12/1926 | Middlekauff | 473/566 |
| 3,479,030 | 11/1969 | Merola | 473/566 |
| 3,963,239 | 6/1976 | Fujii | 473/566 |
| 4,063,732 | 12/1977 | Scott et al. | 473/566 |
| 4,505,479 | 3/1985 | Souders | 473/566 |
| 5,511,777 | 4/1996 | McNeely | 473/566 |
| 5,628,509 | 5/1997 | Christian | 473/562 |

OTHER PUBLICATIONS

"Batrite" Bats, (advertisement), "The Sporting Goods Dealer", p. 33, Nov. 1972.

*Primary Examiner*—Mark S. Graham
*Attorney, Agent, or Firm*—Morland C. Fischer

[57] ABSTRACT

A redundant locking system for reliably securing a weldless knob to the handle of a metal baseball or softball bat to prevent the risk of a detachement of the knob from the handle and the possibility of injury to nearby persons and property in response to pulling forces applied to the knob during use of the bat. A first locking feature includes a high strength anaerobic adhesive bond that is established at the interface of the bat handle and the knob when the handle is received within a longitudinal cavity formed in the knob. A back-up locking feature includes a resilient locking ring that is located in a circumferential channel of the knob to surround the handle. The locking ring is relocated from the circumferential channel to a tapered ring retention chamfer of the knob to be clamped around the handle and thereby prevent the detachment of the knob from the handle should the adhesive bond fail when the pulling forces are applied to the knob.

10 Claims, 2 Drawing Sheets

WELDLESS KNOB FOR METAL BASEBALL AND SOFTBALL BATS

BACKGROUND OF THE INVENTION

1. Field of the Invention

This invention relates to a redundant locking system for reliably securing a weldless knob to the handle of metal baseball and softball bats to prevent a detachment of the knob from the handle in response to pulling forces applied to the knob during use of a bat.

2. Background Art

Metal (e.g. aluminum) bats are becoming increasingly popular among baseball and softball enthusiasts as replacements for the traditional wooden bats. However, during the manufacture of the convention metal bats, a knob is typically welded to the knob receiving end of a tubular handle of the bat. The process for welding the knob to the bat handle is relatively complex and is known to increase the time required to assemble a metal bat.

More importantly, welded knobs have been known to come loose and separate from the bat handle. That is, the weld for securing the knob to the handle sometimes breaks in response to pulling forces that are applied to the knob during the swing of a batter. As a consequence of the foregoing, the bat may fly out of the batter's hands and strike nearby persons or property with the risk of inflicting injury or damage.

Therefore, what is needed is a high strength means to mechanically and reliably lock a weldless knob to the handle of a metal bat to facilitate the assembly of the bat, improve the esthetic appearance, and reduce the chance that the knob may break completely off the end of the handle with the possibility of causing serious injury.

SUMMARY OF THE INVENTION

In general terms, this invention relates to a redundant locking system by which to overcome the problems associated with conventional metal baseball and softball bats having knobs welded to bat handles. By virtue of the foregoing, the risk is reduced that the knob could break completely off the handle during a batter's swing with the possibility of causing injury to nearby persons or property. The redundant locking system disclosed herein incorporates two independent locking features into a metal bat to reliably secure a weldless knob to the bat handle while avoiding the inconveniences associated with the manufacture and assembly of conventional metal bats having the usual welded knobs.

As a first locking feature, an adhesive bond is established when a high strength anaerobic adhesive is located at the interface of the weldless knob and the knob receiving end of the bat handle to secure the knob and handle to one another. However, should the adhesive bond fail under load when a pulling force is applied to the knob, a back-up locking feature is also provided to prevent a detachment of the knob from the handle. The back-up locking feature includes a metal snap ring that is seated within a ring locating groove around the knob receiving end of the bat handle. In the event that the adhesive bond fails and the knob breaks loose from the handle in response to a pulling force applied to the knob, the ring will be relocated from a circumferential channel in the knob to a tapered ring retention chamfer in the knob which lies immediately adjacent to the circumferential channel. By virtue of relocating the locking ring into the tapered ring retention chamfer of the knob, the ring will be squeezed or compressed so as to form a clamp against and around the ring locating groove in the bat handle in which the ring is seated. Accordingly, the compressed locking ring will prevent the disconnection of the knob from the knob receiving end of the handle by reliably clamping the knob and handle together during the application of the pulling force to the knob.

DETAILED DESCRIPTION

Figure 1:
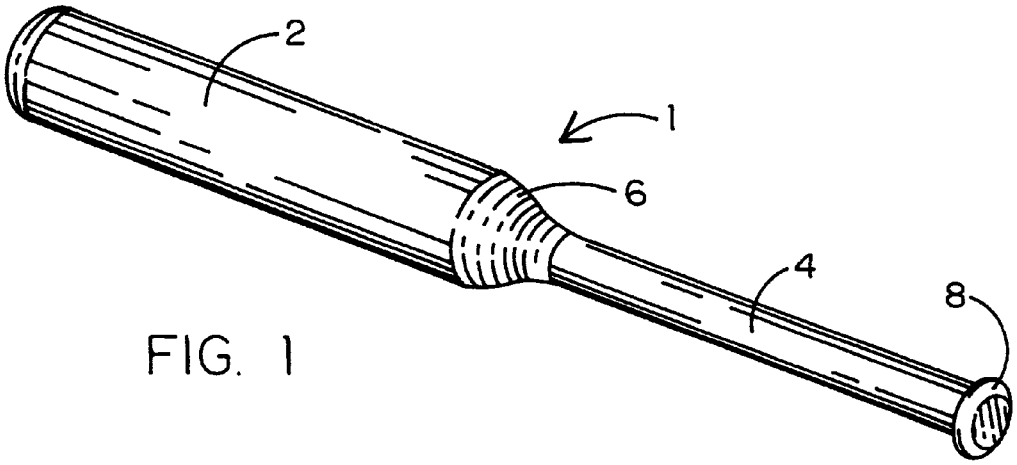
FIG. 1 shows a metal baseball or softball bat of the type to which the weldless knob of this invention is attached.

FIG. 1 of the drawings shows a metal bat 1 of the type to which the present invention relates. The bat 1 has a hollow interior and is manufactured from aluminum, or the like, to be used by both men and women for playing baseball or softball. Bat 1 includes a relatively wide barrel 2 at a first end thereof for making contact with a baseball or softball, a hollow tubular handle 4 at the opposite end at which the bat is gripped, and a tapered neck 6 coextensively connected between the barrel 2 and the handle 4. A knob 8 is manufactured from metal (e.g. aluminum) and affixed to handle 4 to prevent the hands of the batter from sliding off the bat 1 to reduce the risk that the batter might inadvertently loose his grip and throw the bat during a swing with the risk of causing injury to persons and property.

In accordance with the present improvement, a redundant locking system is described by which to overcome the problem associated with conventional metal bats having welded knobs by avoiding the possibility that the knob could break off and become detached from the handle leaving the bat in the same condition and with the same risk of injury as if the bat contained no knob at all. That is to say, the redundant locking system of this invention incorporates two independent locking features into the metal bat 1 of FIG. 1 to ensure that the knob 8 will not become completely detached and pull away from the handle 4. As one locking feature, a high strength adhesive is used to bond the knob 8 to the handle 4. As the second, redundant locking feature, a metal snap ring cooperates with a chamfer formed around the interior of the knob 8 to prevent a detachment of the knob 8 from the handle 4 in the event that the adhesive bond should fail during use, such that the knob 8 could break completely off the handle 4 and separate therefrom.

Figure 2:
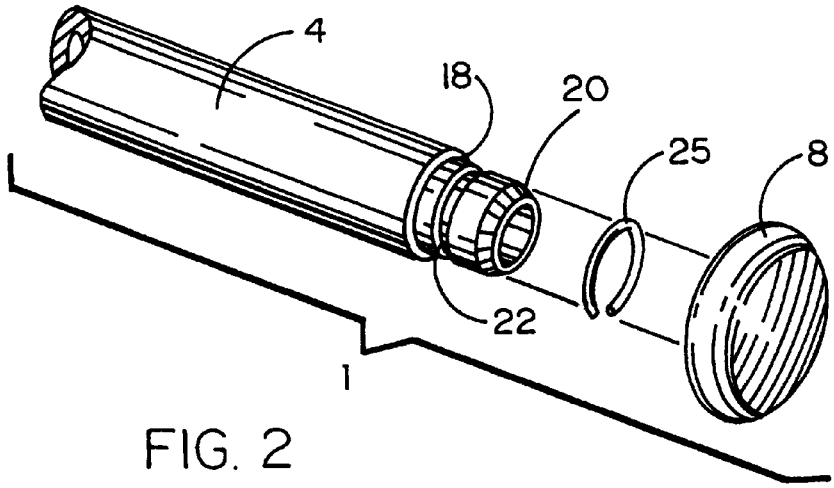
FIG. 2 is an exploded view showing a locking ring with the weldless knob and the knob receiving end of the handle of the bat of FIG. 1.
Figure 3:
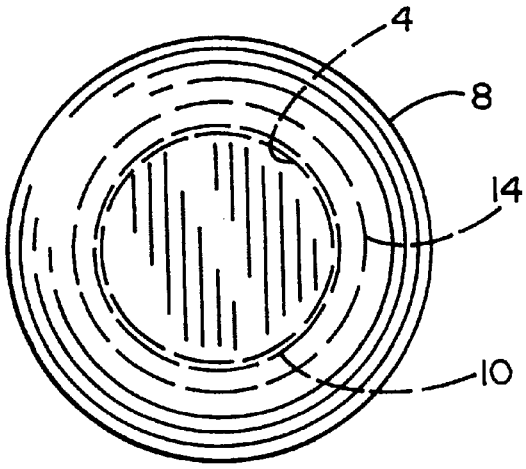
FIG. 3 is an end view of the bat of FIG. 1 showing the weldless knob connected to the bat handle.
Figure 5:
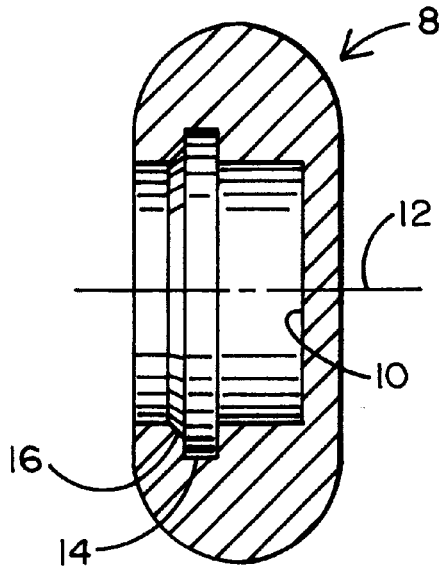
FIG. 5 is a cross-section of the weldless knob of the bat of FIG. 1.

More particularly, and turning next to FIGS. 2 and 5 of the drawings, the metal knob 8 that is to be reliably attached to and locked against the metal handle 4 of the bat 1 has a solid cross-section except for a cylindrical cavity 10 extending inwardly of the knob. By way of example only, the knob 8 has a length of 0.625 inches along its longitudinal axis 12, such that the cylindrical cavity 10 has a longitudinal depth of about 0.52 inches within the knob. Moreover, the maximum outside diameter of the knob 8 is 1.6 inches, while the corresponding diameter of the cylindrical cavity 10 is 0.8 inches.

A circumferential channel 14 is formed within the knob 8 so as to lie in surrounding coaxial alignment and communicate with the cylindrical cavity 10. The diameter of the (channel 14 is 0.2 inches greater than the diameter of the cylindrical cavity 10. As an important detail of this invention, a tapered ring retention chamfer 16 is machined into the knob immediately adjacent and ahead of the circumferential channel 14 thereof so that the channel 14 and chamfer 16 communicate with one another. The maximum diameter of the ring retention chamfer 16 is larger than the diameter of the cylindrical cavity 10 but less than the diameter of the circumferential channel 14 for a purpose that will soon be disclosed.

Figure 4:
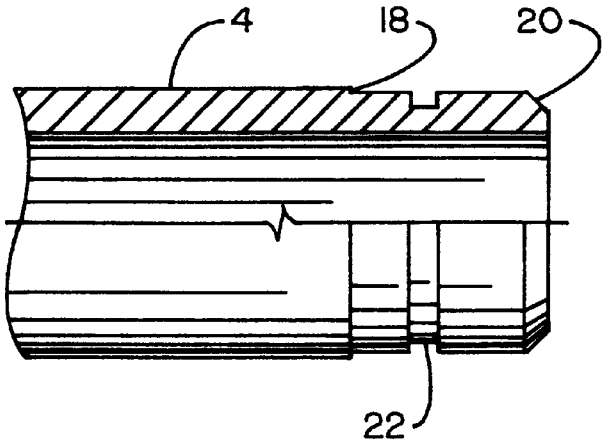
FIG. 4 is an enlarged detail of the knob receiving end of the handle of the bat of FIG. 1.

Referring to FIG. 4 of the drawings, an enlarged detail is shown of the knob retaining end of the hollow tubular handle 4 of the bat 1. To be suitably positioned within and properly connected to the knob 8 of FIG. 5, the outside diameter of handle 4 is 0.815 inches. In this regard, the last 0.58 of the knob retaining end of the handle 4 will be received by the cylindrical cavity 10 so as to be surrounded by the knob 8 (best shown in FIG. 6). To this end, a peripheral lip 18 is machined into the handle 4 to form an abutment for the knob 8 in the assembled relationship showing in FIG. 6. What is more, a tapered lead-in chamfer 20 is machined into the face of the knob retaining end of the handle 4 to facilitate the receipt of the handle 4 by the cylindrical cavity 10 of the knob 8.

A ring locating groove 22 is machined around the knob retaining end of the handle 4 between the peripheral lip 18 and the lead-in chamfer 20. The precise location of ring locating groove 22 is selected so that in the assembled configuration of FIG. 6, the groove 22 of handle 4 and the circumferential channel 14 of knob 8 lie in spaced coaxial alignment with one another with the channel 14 surrounding the groove 22 so that a locking ring (designated 25 in FIG. 6) can be received at the space between the opposing groove 22 and channel 14 fir a purpose that will soon be described.

In this regard, FIG. 2 of the drawings illustrates the assembly of the locking ring 25 with the knob retaining end the handle 4 of bat 1 and the knob 8. The locking ring 25 is a commercially available snap ring that is manufactured from spring steel and is sized to surround the knob receiving end of handle 4 and seat within the ring locating groove 22 thereof (best shown in FIG. 6). FIG. 2 shows the locking ring 25 as having a round cross-section. However, it is to be understood that locking ring 25 may have other suitable shapes including cross-sections which are square, rectangular, oval, and the like. Moreover, the dimensions of the spring locating groove 22 around the handle 4 will be chosen to accommodate the locking spring 25 therewithin.

Figure 6:
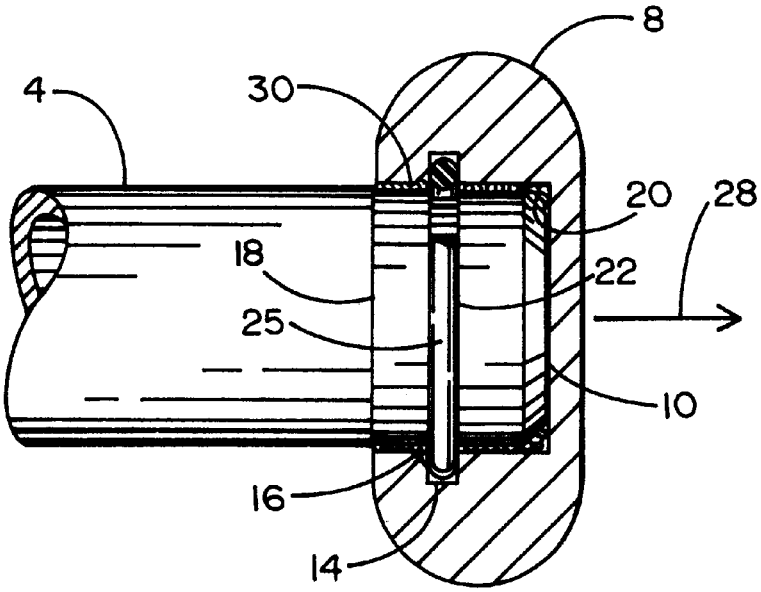
FIG. 6 shows the redundant locking system of the present invention to reliably secure the weldless knob to the knob receiving end of the bat handle.

The redundant locking system of the present invention by which the weldless knob 8 is reliably connected to the knob receiving end of the handle 4 of bat 1 is now described in detail while referring to FIG. 6 of the drawings where the bat is shown at rest when no outward pulling forces are being applied to the knob 8 which could act to break the connection between and separate the knob 8 from the handle 4. The knob receiving end of the handle 4 is moved inwardly of the cylindrical cavity 10 which extends longitudinally through the knob 8, whereby the handle 4 is surrounded by the knob 8. The primary locking feature that is incorporated into the bat 1 is a high strength adhesive 30 that is disposed at the interface of the handle 4 and the wall of the cylindrical cavity 10 of knob 8 which lies ahead of ring retention chamfer 16. The high strength adhesive is preferably a fast drying anaerobic adhesive such as Type 680 manufactured by Loctite Corporation. The purpose of adhesive 30 is to prevent the axial displacement and rotation of the knob 8 relative to the handle 4.

In the event that the adhesive 30 should fail during the swing of a batter when mechanical forces are applied against the knob 8, the locking ring 25 and the ring retaining chamfer 16 cooperate with one another to establish a high strength back-up locking feature to prevent the knob 8 from being pulled completely off the knob receiving end of the handle 4 so as to avoid the possibility of injury to persons and property. More particularly, the locking ring 25 will remain in the at rest position of FIG. 6 seated in ring locating groove 22 and surrounded by the circumferential channel of 14 of knob 8 so long as the integrity of the adhesive 30 remains intact. However, should the adhesive fail under a load (e.g. a pulling force applied to knob 8 in the direction of reference arrow 28), the locking ring 25 will be correspondingly relocated from the circumferential channel 14 of knob 8 into the ring retaining chamfer 16. As earlier disclosed, the maximum diameter of chamfer 16 is less than the diameter of the circumferential channel 14 within which the ring 25 is initially disposed. Accordingly, the spring-like locking ring 25 will be squeezed or compressed upon its receipt by the tapered ring retaining chamfer 16 so as to form a clamp around th(e ring locating groove 22 and against the knob receiving end of handle 4. in which ring 25 is seated.

By virtue of the foregoing, the locking ring 25 in the aforementioned compressed condition in chamfer 16 will prevent the detachment and complete separation of the knob 8 from the handle 4 by reliably holding the knob and handle together in response to the pulling force applied to knob 8. At the conclusion of the batter's swing when the pulling force against knob 8 has concluded, the bat may be immediately taken out of service with the knob 8 still safely coupled to the handle 4 of means of locking ring 25.

As an additional advantage of the present invention, the weldless knob 8 can be anodized separately from the handle 4, whereby to improve the overall aesthetic appearance of the finished bat 1. Such a separate anodizing step is not easily achieved in conventional metal bats where the knob is welded directly to the handle. In this same regard, a metal bat may be more easily and quickly assembled, because the relatively complex step of welding the knob to the handle common to conventional bats, can now be eliminated by using the weldless knob 8 described above.

I claim:

1. A metal bat having a barrel for striking a ball, a handle by which the bat is held in the hands of a batter, a first end of the handle connected to the barrel, a knob attached to a second end of the handle to prevent the batter's hands from sliding off the handle, and retaining means for securing the knob to the handle and preventing a detachment of the knob from the handle when a pulling force is applied to the knob during use of the bat, said retaining means including an adhesive bond established between the knob and the second end of the handle, said retaining means also including a cavity extending longitudinally within said knob so as to receive the second end of said handle, whereby said adhesive bond is established in said cavity at the interface of said knob and said second end, a channel found in said knob to surround and communicate with said cavity, and a resilient locking ring located within said channel for holding said knob and said handle together when said handle is received in the cavity of said knob.

2. The metal bat recited in claim 1, wherein said handle is tubular and said cavity in said knob is cylindrical so as to accommodate the second end of said handle therewithin.

3. The metal bat recited in claim 1, wherein said adhesive bond is formed from a high strength anaerobic adhesive.

4. The metal bat recited in claim 1, wherein the second end of said handle has a ring locating groove extending therearound and spaced opposite the channel in said knob, said locking ring being seated within said locking groove so as to engage the second end of said handle.

5. The metal bat recited in claim 4, wherein said knob also has a tapered chamfer lying adjacent to and communicating with the channel of said knob, said locking ring being relocated from said channel to said tapered chamfer in response to said pulling force applied to said knob to cause said locking ring to be clamped against the second end of said handle to prevent the detachment of said knob from said second end.

6. A metal bat having a barrel for striking a ball, a handle by which the bat is held in the hands of a batter, a first end of the handle connected to the barrel, a knob attached to a second end of the handle to prevent the batter's hands from sliding off the handle, said knob having a cavity extending longitudinally therein for receiving the second end of said handle and a channel communicating with said cavity, and retaining means for securing the knob to the handle and preventing a detachment of the knob from the handle when the second end of the handle is received within the cavity in the knob and a pulling force is applied to the knob, said retaining means including a resilient locking ring disposed within said channel to surround and engage the second end of the handle for holding the knob and the handle together.

7. The metal bat recited in claim 6, wherein said knob also has a tapered chamfer lying adjacent to and communicating with said channel, said locking ring being relocated from said channel to said tapered chamfer in response to said pulling force applied to said knob to cause said locking ring to be clamped against the second end of said handle to prevent the detachment of said knob from said second end.

8. The metal bat recited in claim 6, wherein said retaining means also includes an adhesive bond established at the interface of said knob and the second end of said handle when said second end is received in the cavity of said knob.

9. The metal bat recited in claim 8, wherein said adhesive bond is formed from a high strength anaerobic adhesive.

10. The metal bat recited in claim 6, wherein said resilient locking ring is a metal snap-ring having a spring-like memory.

* * * * *